United States Patent [19]

Pinckaers

[11] Patent Number: 4,904,986

[45] Date of Patent: Feb. 27, 1990

[54] IR FLAME AMPLIFIER

[75] Inventor: B. Hubert Pinckaers, Bloomington, Minn.

[73] Assignee: Honeywell Inc., Minneapolis, Minn.

[21] Appl. No.: 293,377

[22] Filed: Jan. 4, 1989

[51] Int. Cl.[4] ..... G08B 17/12; F23N 5/08

[52] U.S. Cl. ..... 340/578; 250/554; 431/79

[58] Field of Search ..... 340/577–578; 250/554; 431/78–79

[56] References Cited

U.S. PATENT DOCUMENTS

| | | | |
|---|---|---|---|
| 3,202,976 | 8/1965 | Rowell | 430/213 |
| 3,299,361 | 1/1967 | Pinckaers | 328/6 |
| 3,421,156 | 1/1969 | Rowell | 340/228 |
| 3,541,549 | 11/1970 | Graves | 340/410 |
| 3,742,474 | 6/1973 | Muller | 340/228 |
| 3,820,097 | 6/1974 | Larson | 340/228 |
| 3,822,408 | 7/1974 | Veranth | 330/99 |
| 3,936,648 | 2/1976 | Cormault et al. | 250/554 |
| 3,947,218 | 3/1976 | Landis | 431/79 |
| 4,033,711 | 7/1977 | Christian et al. | 431/66 |
| 4,039,844 | 8/1977 | MacDonald | 250/554 |
| 4,100,407 | 7/1978 | Takahashi | 250/214 |
| 4,227,155 | 10/1980 | Lerma | 330/11 |
| 4,235,587 | 11/1980 | Miles | 431/73 |
| 4,298,334 | 11/1981 | Clark et al. | 431/24 |
| 4,370,557 | 1/1983 | Axmark et al. | 250/554 |
| 4,381,455 | 4/1983 | Komori | 250/554 |
| 4,395,638 | 7/1983 | Cade | 250/554 |
| 4,451,226 | 5/1984 | Landis et al. | 431/15 |
| 4,455,487 | 6/1984 | Wendt | 340/578 X |
| 4,540,886 | 9/1985 | Bryant | 250/554 |
| 4,591,725 | 5/1986 | Bryánt | 250/554 |

*Primary Examiner*—Glen R. Swann, III
*Assistant Examiner*—Thomas J. Mullen, Jr.
*Attorney, Agent, or Firm*—Kinney & Lange

[57] ABSTRACT

A flame detector, for use with a photocell which produces a flame signal when the photocell is exposed to a flame, is used for detecting the presence of a flame. An input circuit is coupled to the photocell for receiving and buffering the flame signal. The buffered flame signal is filtered and amplified in a filter. An output circuit further amplifies the filtered flame signal providing an output flame signal. A switch is also used in the flame detector for substantially short circuiting the flame signal to a known value upon receiving a switch-close signal from either a test computer or from a hot refractory detection circuit. A flame-out condition is detected by the hot refractory detection circuit which generates an HRD signal causing the flame signal to be substantially short circuited to a known value thereby eliminating a false flame signal caused by hot refractory shimmering.

56 Claims, 3 Drawing Sheets

IR FLAME AMPLIFIER

BACKGROUND OF THE INVENTION

1. Field of the Invention.

This invention relates to a flame detection circuit. More particularly, this invention relates to an amplifier in a flame detection circuit including a hot refractory detection circuit which substantially eliminates a false flame signal caused by hot refractory shimmering.

2. Description of the Prior Art.

There are many applications for large boilers and burners which use flame heating. In all of these applications, it is desirable to be able to detect whether the flame is present in order to control the flow of fuel to the burner or boiler. There are several ways of detecting the presence of a flame. Generally, a flame detector, or photocell, is used to detect the presence of a flame. An amplifier is used to amplify the signal emitted by the flame detector. This amplified signal is monitored by a burner control system which controls fuel pumping mechanisms based on, among other things, the amplified signal. Flame detectors include ultraviolet radiation detectors, visible light detectors, and infrared sensors which detect the flickering of the flame.

Previous sensing methods have not been fully satisfactory in dealing with a problem known as "hot refractory." Typically, in a burner or boiler, the fire is confined in a chamber which is lined with refractory material. When the burner has been on for a long time, the refractory material begins to glow red. Even if the flame goes out, the red glow of the refractory material does not immediately disappear. Therefore, the visible light sensors do not accurately represent whether the flame is present. Additionally, air currents passing over the hot refractory material can cause a shimmering effect which deceives an infrared flame flicker sensor (IR sensor) into producing a flame signal which erroneously represents that a flame is still present. As long as the flame sensor does not detect that the flame has gone out (a flame-out condition), the burner control system will continue to supply fuel to the burner. If there is in fact no flame, the congregation of fuel in the burner area may result in a very severe explosion.

Because of the severe consequences resulting from an error in the flame detection circuitry, an important and desirable characteristic of the flame detection circuit is reliability. Also, the circuitry must be able to detect the difference between an actual flame and hot refractory shimmering.

To achieve reliability, some method must be implemented for testing the detection circuitry. One method for testing flame detection circuitry is disclosed in the Rowell U.S. Pat. No. 3,202,976. This method involves feeding back the output of the flame detection circuitry to the input in such a way that makes the input disappear. When the input disappears, of course, the output disappears and consequently, through feedback, the input reappears. Therefore, a cyclical condition is created at the output which can only arise if there truly is an output to begin with. The frequency of the cyclical condition depends on the time constants of all the various circuits in the amplifier. However, the technique used to achieve reliability in the Rowell patent does not deal with the problem of an erroneous flame signal caused by hot refractory shimmering Moreover, that technique is not readily applicable to a flame detector based on the use of an IR sensor to detect flame flicker.

This is because feedback of the output to the input to achieve the cyclical condition at the output when a true input is present can, by itself, cause a cyclical output.

A desirable characteristic of any test method is that the test should encompass all of the hardware in the flame detection circuit, if possible This is very difficult to achieve and there is a continuing need for these test methods.

Noise rejection is also very important and desirable in a flame detection circuit. Techniques must be employed throughout the circuitry to maximize the signal-to-noise ratio. Also, since the burners require some type of ignition, the detection circuitry should reject spark ignition noise. Similarly it is desirable that the circuit be insensitive to noise with a frequency of about 60 Hz since that noise is generally prevalent in industrial burners of this type and since the maximum flicker intensity for a gas flame occurs at approximately 12 to 14 Hz.

Some of the flame amplifiers which are presently used in flame detection circuitry reject some high frequency noise but pass frequencies as low as 2 to 3 Hz. However, a step input to the amplifier, which occurs for instance when the flame goes out, results in damped oscillation ringing through the amplifier. The frequency of the ringing depends on the time constants throughout the amplifier. Therefore, if the flame suddenly goes out, the low frequency, damped sinusoid, which occurs at approximately 2 to 3 Hz, may last long enough and be amplified enough to be mistaken as a flame-on condition by the control system. Therefore, amplifiers which pass low freqencies in the range of 2 to 3 Hz are undesirable.

SUMMARY OF THE INVENTION

The present invention is not only a reliable flame detection amplifier with good noise rejection characteristics, but it also detects and accounts for hot refractory shimmering. An IR sensitive photocell is used for detecting a flame and producing a flame signal. Input means are coupled to the photocell and receive and buffer the flame signal thereby providing a buffered signal. Filter means are coupled to the input means for filtering and amplifying the buffered signal thereby providing a filtered flame signal. Output means are coupled to the filter means for further amplifying the filtered flame signal thereby providing an output flame signal. Switch means are coupled to the photocell for substantially short circuiting the flame signal to a known value upon receiving a switch-close signal. Hot refractory detection means are also coupled to the photocell for detecting a flame-out condition and generating a hot refractory detection signal causing the flame signal to be substantially short circuited to a known value thereby eliminating a false flame signal caused by hot refractory shimmering.

DETAILED DESCRIPTION OF THE PREFERRED EMBODIMENTS

Overview

Figure 1:
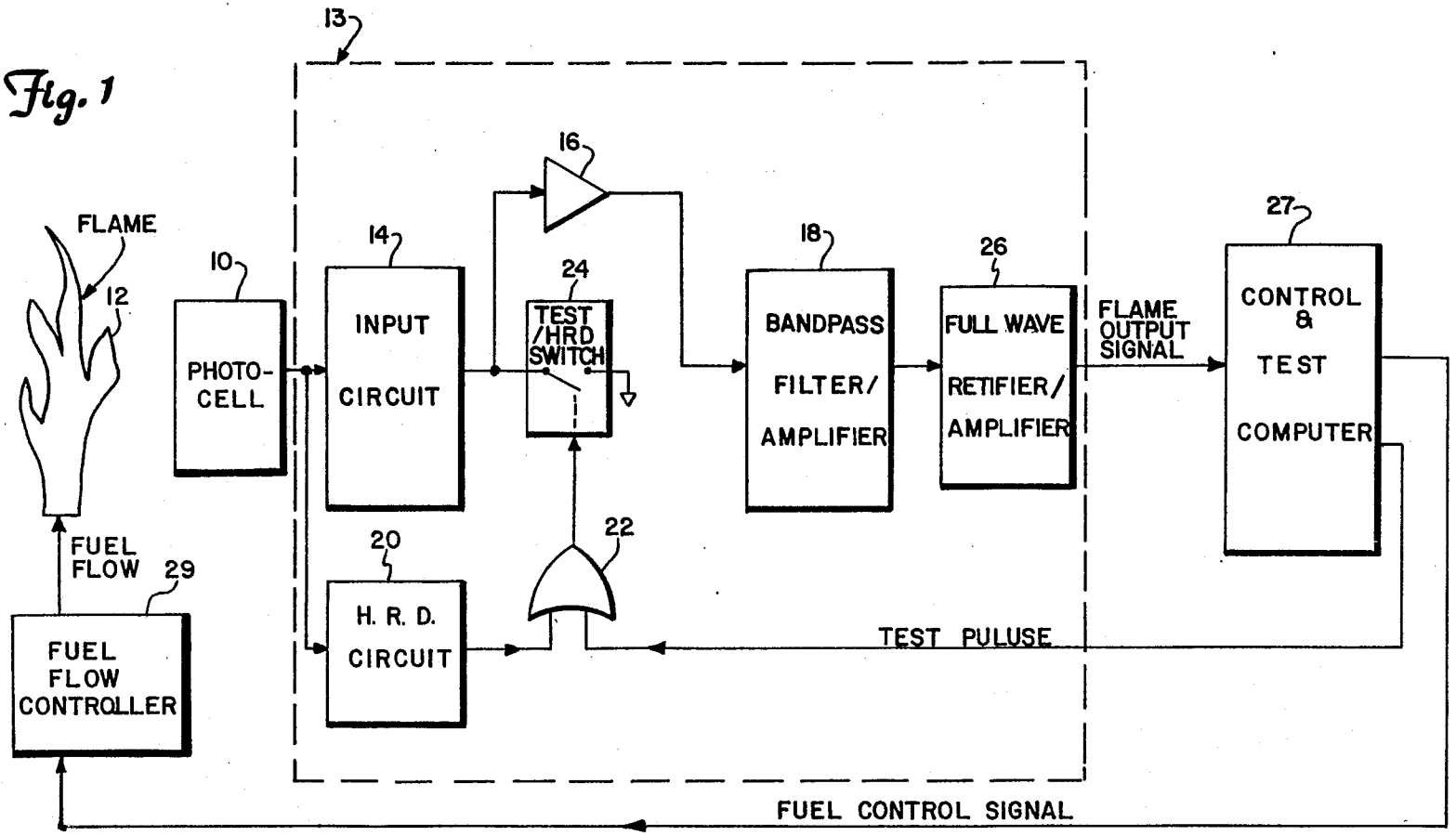
FIG. 1 is a block diagram of the flame detection circuitry.

A block diagram of the flame detection circuit of the present invention is shown in FIG. 1. Photocell 10 is exposed to flame 12. Photocell 10 emits a flame signal representative of infrared radiation impinged upon it from flame 12. The flame signal contains an AC component which is due to the flicker of flame 12. The flame signal also contains a DC component which is due to the presence or absence of flame 12.

IR amplifier 13 is comprised of input circuit 14, buffer 16, hot refractory detector (HRD) circuit 20, "OR" connection 22, test/HRD switch 24, bandpass filter-/amplifier 18, and full wave rectifier/amplifier 26. Input circuit 14 is AC coupled to photocell 10 and detects the AC component of the flame signal. Input circuit 14 provides the flame signal to buffer 16 which, in turn, provides a buffered flame signal to filter 18.

However, when flame 12 goes out, the DC component of the flame signal will change and photocell 10 will provide the flame signal in the form of a step input to input circuit 14. Also, if the hot refractory material surrounding flame 12 is glowing red and air currents pass over it, hot refractory shimmering will occur. Either the step input or the hot refractory input could be interpreted by input circuit 14 as an AC component of the flame signal and be provided to filter 18 through buffer 16 which would result in a false flame output signal. In order to prevent this, HRD circuit 20 is used. HRD circuit 20 is coupled to photocell 10 and detects the step response in the flame signal caused by flame 12 going out. HRD circuit 20 emits an HRD signal which is "OR" connected with a test pulse at "OR" connector 22. "OR" connector 22 provides a switch control signal to switch 24. The switch control signal causes switch 24 to short circuit the input to buffer 16 to ground. Therefore, when flame 12 goes out, neither a step input nor a hot refractory shimmering input will be provided to buffer 16 and the erroneous flame output signal is eliminated.

Similarly, a test pulse is periodically generated from control computer 27 in order to test IR amplifier 13. The test pulse causes switch 24 to short the input to buffer 16 to ground and the flame output is then monitored by control computer 27 to assure that it is in the proper state.

When neither the test pulse nor the HRD signal are present, the buffered flame signal provided by buffer 16 is filtered and amplified by filter 18. The filtered and amplified flame signal is provided to full wave rectifier-/amplifier 26. Full wave rectifier/amplifier 26 rectifies the AC flame signal and converts it to substantially a DC signal which is amplified and provided as a flame output signal to control computer 27. If the flame output signal indicates that flame 12 has gone out, control computer 27 sends a fuel control signal to fuel flow controller 29 which shuts off the flow of fuel to the burner to avoid an undesirable accumulation of fuel.

Photocell 10

One possible embodiment of photocell 10 is a lead sulfide photocell, biased by a power supply, which has a resistance that varies as a function of the infrared radiation incident upon it. When photocell 10 is in the dark, it has a resistance on the order of several megohms. This is called the "dark resistance." When a certain amount of infrared radiation impinges upon photocell 10, the resistance decreases to what is called its "light resistance" which is on the order of one-half to one megohm, for example.

Figure 2:
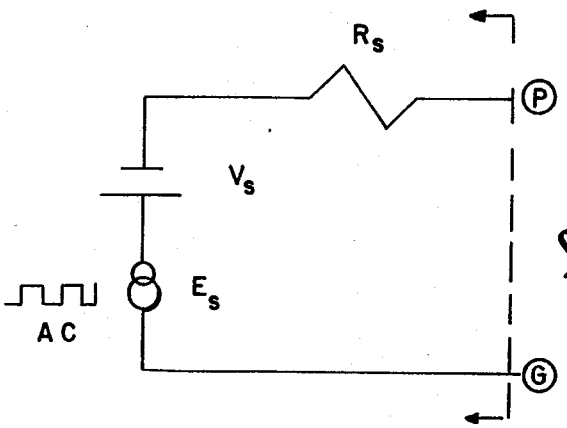
FIG. 2 is a circuit equivalent of a photocell detecting the presence of a flame.

When flame 12 is present, the flickering of flame 12 causes undulations in the level of infrared radiation emitted by flame 12 which results in small undulations in the resistance value of photocell 10 relative to its light resistance. Therefore, when a flame is present, photocell 10 may be represented by the equivalent circuit shown in FIG. 2. The flame signal emitted by photocell 10 will have a DC component $V_s$ and an AC component (flame flicker signal) $E_s$ superimposed on it. Additionally, photocell 10 will have a source resistance $R_s$.

In order to detect the flickering of flame 12, it is necessary for input circuit 14 to pick up the small flame flicker signal $E_s$ which represents the flicker. Since the flame flicker signal $E_s$ emitted by photocell 10 is due to small undulations in the resistance of photocell 10, a higher flame flicker signal will result if photocell 10 is biased by a higher voltage The higher the flame flicker signal, the less gain is required throughout the rest of the circuit. Therefore, powering photocell 10 with a high voltage results in a much improved signal-to-noise ratio.

Figure 3:
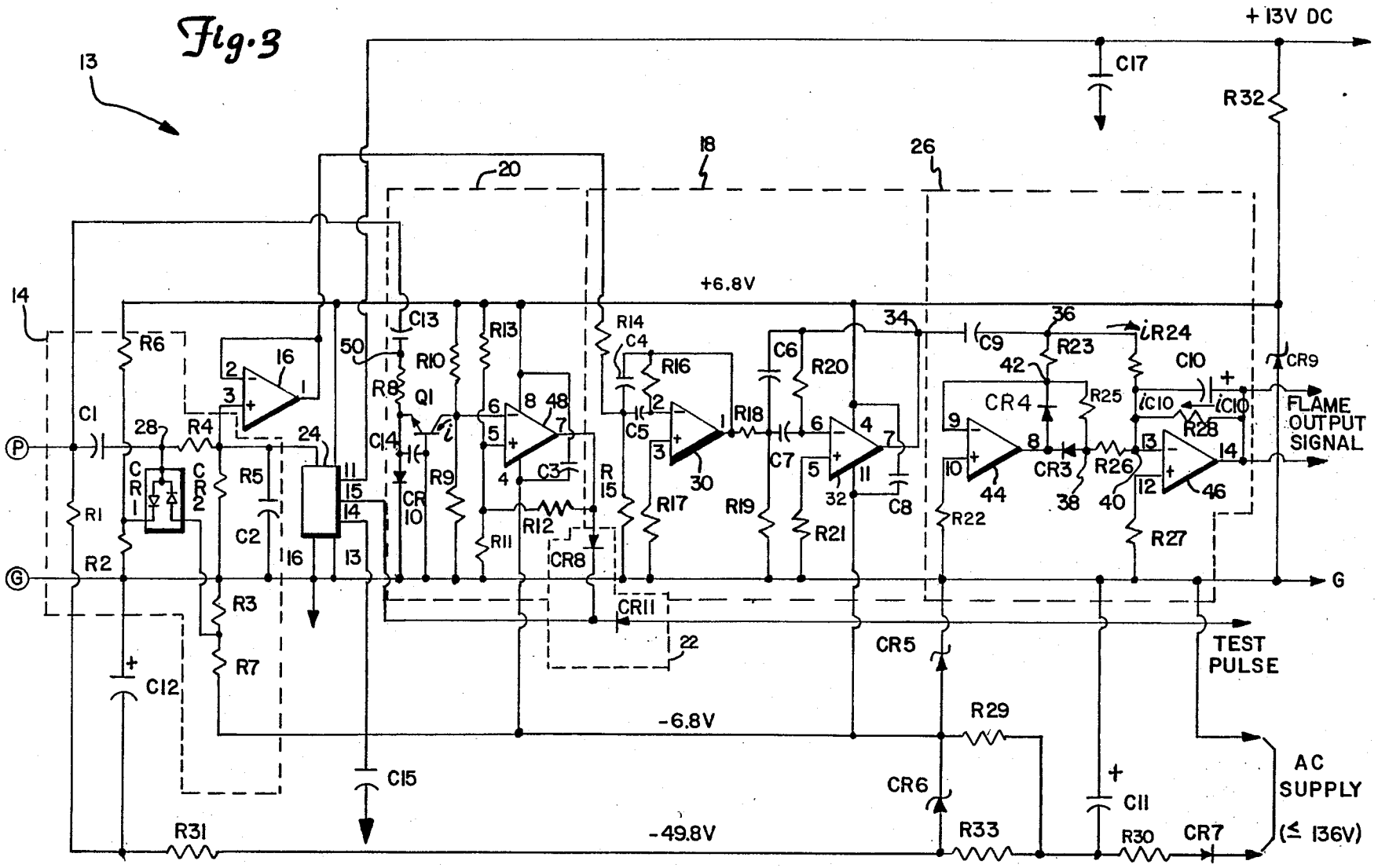
FIG. 3 is a detailed schematic diagram showing an implementation of the flame detection circuit of the present invention.

FIG. 3 shows a detailed schematic diagram of IR amplifier 13. As shown in FIG. 3, a voltage of 49.8 V is used to bias photocell 10 through resistors R1 and R31. Since this relatively large voltage is used to bias photocell 10, the signal-to-noise ratio of the flame flicker signal which appears across terminals P and G is improved.

Input Circuit 14

Input circuit 14, as shown in FIG. 3, includes resistors R1–R7, capacitors Cl and C2, and diodes CR1 and CR2. Input circuit 14 receives the flame flicker signal from photocell 10 at terminals P and G.

The signal appearing across terminals P and G also has a DC component which is due to the light resistance of photocell 10. However, since input circuit 14 is AC coupled to photocell 10 at terminals P and G, through capacitor Cl, the DC component appearing across terminals P and G is not sensed by input circuit 14. Rather, the flame flicker signal is sensed by input circuit 14 and is coupled by capacitor Cl to a filter comprised of resistor R4 and capacitor C2. One side of photocell 10 is grounded; therefore, noise which is picked up at a frequency of approximately 60 Hz is easily bypassed to ground through capacitor C2.

Input circuit 14 is designed to maximize the flame flicker signal $E_s$ by making:

$$R5 >> Rs + R4 - j\frac{1}{2\pi fcl} \quad (1)$$

(for $f > 3$ or 4 Hz)

Load resistor R5 is chosen to equal approximately the square root of the product of the dark and light resistances of photocell 10. This results in the best voltage transfer of the flame flicker signal.

Generally, the flame flicker signal appears across load resistor R5 and is thereby applied to buffer 16. Buffer 16, in this preferred embodiment, is an operational amplifier and acts as an impedance converter. It is set up to have unity voltage gain, a high input impedance, but a low output impedance. This results in buffer 16 having good drive capability.

The flame flicker signal from input circuit 14 is typically buffered by buffer 16 and provided to filter 18. However, there are several other very important characteristics which input circuit 14 and buffer 16 are required to have. First, buffer 16 is an operational amplifier powered by a dual voltage supply of ±6.8 V. Therefore, the inputs to buffer 16 must be kept within ±6.8 V in order to prevent damage to the device. Since photocell 10 is capable of providing transient signals to input circuit 14 which are well in excess of ±6.8 V (for instance during a flame-out condition), it is necessary for input circuit 14 to have a voltage limiter to prevent that transient from being applied to any devices in IR amplifier 13 which could be damaged.

The voltage limiter in input circuit 14 is comprised of bias resistors R2, R3, R6 and R7, and diodes CR1 and CR2. Since any signal which is applied to the input of buffer 16 that is above +6.8 V or any signal applied to the input of buffer 16 that is below −6.8 V will damage buffer 16, the voltage limiter must limit voltages in both positive and negative direction (i.e., the voltage limiter must be a symmetrical voltage limiter). Diodes CR1 and CR2 are used to clip any signal appearing at node 28 to a level which will not damage any devices in IR amplifier 13. Bias resistors R2 and R6, and bias resistors R3 and R7 form two voltage dividers from +6.8 V to ground and from −6.8 V to ground, respectively, and are chosen such that diodes CR1 and CR2 are back-biased in series in order for the signal appearing at node 28 to be clipped at the desired level. In this preferred embodiment, resistor R2=R3=10K and resistor R6=R7=100K. With these parameters, no conduction will occur in diodes CR1 and CR2 before the signal at node 28 goes above approximately 1.2 V..

A second important characteristic which input circuit 14 must have is that there must be substantially zero DC voltage across load resistor R5. During a test pulse or during hot refractory detection, switch 24 is used to short circuit the signal appearing at the input to buffer 16 (i.e., across load resistor R5) to ground. Therefore, if any DC voltage were present across load resistor R5 when switch 24 short-circuited that voltage, a step input would be applied to buffer 16. This would result in a decaying sinusoid output at buffer 16 which would be amplified in filter 18 and full wave rectifier/amplifier 26. This could yield the undesirable result of having a momentary false flame output signal provided to control computer 27.

In order to avoid having a DC voltage across resistor R5, capacitor Cl must have a very low leakage current. Additionally, diodes CR1 and CR2 must exhibit extremely low leakage current in the reverse direction. Also, since any difference between the leakage currents in diodes CR1 and CR2 will flow through resistor R5, it is important that diodes CR1 and CR2 have offsetting leakage currents. For example, if the difference in the leakage currents of CR1 and CR2 ($I_{dif}$) was approximately 10 nanoamps ($10\times10^{-9}$ amps), there would be a DC voltage across load resistor R5 amounting to:

$$V_{R5}=(I_{dif})(R_5)=10\times10^{-9}\times10\times10^{6}\ V$$

which is equal to 0.1 V. This may be too much. Therefore, in this embodiment, diodes CR1 and CR2 are manufactured on a monolithic integrated circuit chip and should have small leakage currents in the reverse direction, and those leakage currents also should be matched (i.e. the same magnitude).

Since there is substantially zero DC voltage across load resistor R5, buffer 16 is chosen to have an extraordinarily low input bias current. In the present embodiment, buffer 16 is an operational amplifier which has an input bias current of only one picoamp ($1\times10^{-12}$ amps) Therefore, the input bias current (one picoamp) multiplied by load resistor R5 (10 megohms) equals $10^{-5}$ V. This voltage, if applied as a step input to buffer 16, is low enough to avoid the momentary false flame output signal.

Filter 18

Buffer 16 buffers the flame flicker signal provided at its input and also filters out some high frequency noise from the flame flicker signal because of the frequency response characteristics of the operational amplifier chosen for buffer 16. The buffered flame flicker signal is provided to filter 18. Since the maximum flicker intensity for a gas flame occurs at approximately 12 to 14 Hz, an ideal flame detection circuit includes a substantially square bandpass filter which passes a frequency band centered around 12 to 14 Hz and rolls off very rapidly at approximately 9 Hz and 18 Hz.

In this preferred embodiment, filter 18 is a two-stage multiple feedback, bandpass amplifier. The first stage is comprised of resistors R14, R15, R16 and R17; capacitors C4 and C5; and operational amplifier 30. The second stage is comprised of resistors R18, R19, R20 and R21; capacitors C6 and C7; and amplifier 32. The two stages of filter 18 are "stagger-tuned." This means that each stage has a maximum gain which peaks at a different frequency. In this preferred embodiment, the first stage has a voltage gain of 9.4 which peaks at 11.3 Hz and has a Q equal to 2.64. The second stage has a voltage gain of 11.3 which peaks at a frequency of 14.9 Hz with a Q equal to 3.82. The first and second stages are designed in accordance with generally accepted filter theory and are staggered so that the peak response occurs at a frequency of approximately 13.5 Hz to 14.0 Hz (the range of flame flicker frequencies).

Filter 18, in this embodiment, has an overall gain at 8.5 Hz and 19.5 Hz which is approximately 20% of the gain at 14 Hz. Additionally, the overall gain at 35 Hz and 5 Hz is less than 2% of that gain at 14 Hz.

Filter 18 supplies an amplified, filtered flame flicker signal at node 34. The signal at node 34, other than a few millivolts of DC voltage caused by offset voltages in amplifiers 30 and 32, is an AC signal.

Full Wave Rectifier/Amplifier 26

Full wave rectifier/amplifier 26 includes resistors R22–R28, capacitors C9 and C1O, diodes CR3 and CR4, and operational amplifiers 44 and 46. The AC signal at node 34 is AC copled through capacitor C9 into full wave rectifier/amplifier 26. Output capacitor C10 is charged in the positive direction during both half cycles of the AC voltage appearing at node 34 (i.e., there is full wave rectification). Charging takes place during the full cycle, not just near the peaks. Therefore, the flame output signal is substantially a DC voltage signal.

Analysis (1). When node 36 is positive with respect to ground,-node 38 will go negative and nodes 40 and 42 will have to stay at or near ground potential. Therefore, capacitor C10, for the half cycle when the AC voltage at node 36 is positive, has a charging current iClO which is derived as follows:

$$(a)\ V36 - \left(\frac{V36 - V38}{R23 + R25}\right)R25 \simeq \emptyset; \tag{2}$$

therefore, $$V38 = -V36\left(\frac{R25}{R23}\right) \tag{3}$$

$$(b)\ i_{R24} = \frac{V36 - V40}{R24} = \frac{V36}{R24} \tag{4}$$

$$(c)(i_{R24} + i_{C10})R26 = V36\left(\frac{R25}{R23}\right) \tag{5}$$

or $$\left(\frac{V36}{R24} + i_{C10}\right)R26 = V36\left(\frac{R25}{R23}\right) \tag{6}$$

Capacitor C10 charging current:

$$i_{C10} = \frac{V36\left(\frac{R25}{R23} - \frac{R26}{R24}\right)}{R26} = V36\left(\frac{\frac{R25}{R23} - \frac{R26}{R24}}{R26}\right) \tag{I}$$

(2). When node 36 is negative with respect to ground, $V_{38}$ is positive by one diode drop and, again, the voltage at node 40 is approximately zero volts. Therefore, the charging current $i_{C10}$ for the half cycle when the AC voltage at node 36 is negative is derived as follows:

$$(i_{C10})(R24) = V36, \text{ hence } i_{C10} = \frac{V36}{R24} \tag{II}$$

(3). For charging current $i_{C10}$ to be equal on both half cycles (which is desirable to minimize ripple), the following should hold:

$$V36\frac{\left(\frac{R25}{R23} - \frac{R26}{R24}\right)}{R26} = \frac{V36}{R24}, \text{ or:} \tag{7}$$

$$R26 = \left(\frac{R25}{R23}\right)R24 - R26, \text{ or:} \tag{8}$$

$$R26 = \left(\frac{1}{2}\right)\left(\frac{R25}{R23}\right)R24 \tag{III}$$

Therefore, if, for example, R23=R25=R24=100kΩ, then:

$$R26 = 1/2\left(\frac{100 \times 10^3}{100 \times 10^3}\right)100 \times 10^3 = 50\ \text{k}\Omega \tag{9}$$

(4). The DC output voltage (i.e., flame output signal VF) can be derived as follows: Using equation II, during both half cycles, charging current $$i_{C10} = \frac{V34}{R24}\ (V34 \simeq V36) \tag{10}$$

If V34 is a sine wave voltage, then $$v34 = V34\sqrt{2}\ \sin wt \text{ (for } V34 = \text{RMS value)}, \tag{11}$$

then $$i_{C10} = \frac{V34\sqrt{2}}{R24}\sin wt \tag{12}$$

$$\text{let } \frac{V34\sqrt{2}}{R24} = Ip \text{ and } T = \frac{1}{f}, \text{ then} \tag{13}$$

($f$ is frequency in Hz of the sine wave)

$$i_{C10} = Ip \sin wt = Ip \sin\left(\frac{2\pi}{T}\right)t \tag{IV}$$

The DC value of $i_{C10}$ which flows into the parallel combination of C10 and R28 is:

$$Idc = Iav = \int_0^{T/2} \frac{Ip \sin\left(\frac{2\pi}{T}\right)t\,dt}{T/2} \tag{14}$$

or $$IDC = \frac{2Ip}{T}\left(\frac{T}{2\pi}\right)\left[-\text{Cos}\frac{2\pi}{T}t\Big|_o^{T/2}\right] = \frac{2}{\pi}Ip \tag{15}$$

so $$IDC = \frac{2}{\pi}Ip \tag{16}$$

Since $i_{C10}$ can be considered to come from a current source, $$VF = VDC = \frac{2}{\pi}(Ip)(R28) \tag{V}$$

Substituting Ip from above, $$VF = \left(\frac{2}{\pi}\right)\left(\frac{R28}{R24}\right)V34\sqrt{2} \tag{17}$$

(where $V34$ = RMS input voltage sinewave), or $$VF = 0.9\left(\frac{R28}{R24}\right)V34 \tag{VI}$$

Figure 4B:
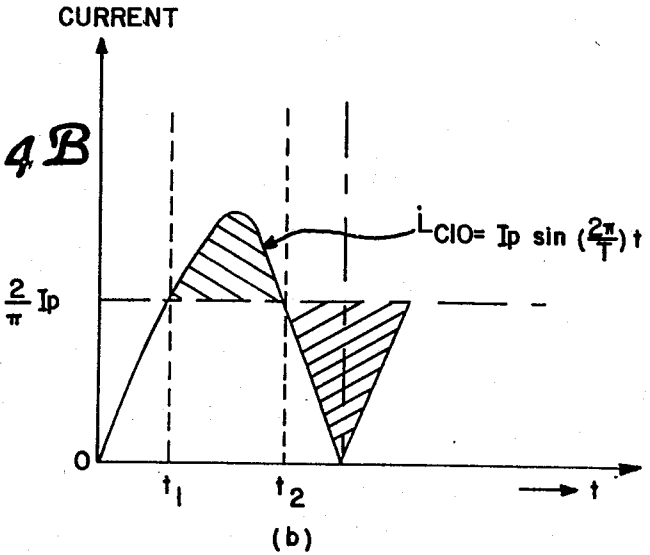
FIG. 4B is a graph of charging current iC10.
Figure 4A:
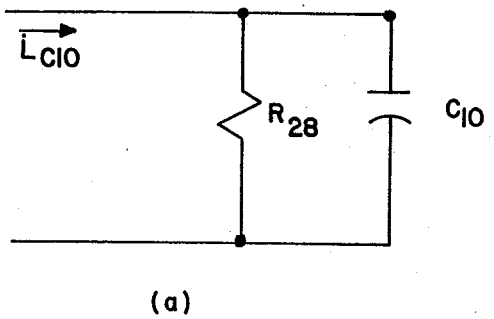
FIG. 4A is a diagram illustrating a portion of the full wave rectifier/amplifier.

(5). The voltage ripple on VF can be calculated as follows (see FIG. 4A):

$$IR28 = \frac{2}{\pi}Ip \tag{18}$$

therefore, C10 stores charge when iC10$>2/\pi$ Ip and loses charge when iC10$<2/\pi$ Ip. Hence, for the ripple on VF to be uniform, the shaded areas above and below the $2/\pi$ Ip line in FIG. 4B must be equal. The charge Q put into capacitor C10 is (in Coulombs):

$$Q = \int_{t1}^{t2} \left[ Ip \sin\left(\frac{2\pi}{T}\right)t - \frac{2}{\pi} Ip \right] dt = \tag{19}$$

$$IP \int_{t1}^{t2} \left[ \sin\left(\frac{2\pi}{T}\right)t - \frac{2}{\pi} \right] dt$$

$$t1 = \frac{\mathrm{Sin}^{-1}\left(\frac{2}{\pi}\right)}{\pi}\left(\frac{T}{2}\right) = \tag{20}$$

$$\frac{0.69}{\pi} \text{ radians}\left(\frac{T}{2}\right) = (0.109834)(T)$$

$$\text{and } t2 = \frac{T}{2} - t_1 = 0.390166T \tag{21}$$

therefore, the charging from $t_1$ to $t_2$ is:

$$Q = \left(\frac{T}{\pi}\right)(0.2105138)(Ip) \tag{22}$$

$$\text{since, for 14 Hz, } T = \frac{1}{14},\ Q = (Ip)(0.00478633) \tag{VII}$$

Thus, the charge Q available each half cycle to store in capacitor C10 is:

$$Q = 0.00478633\ (Ip) = \frac{V34}{R24}\ \sqrt{2}\ (0.00478633) = \tag{23}$$

$$0.00676889\ \frac{V34}{R24}$$

$$\text{since } Q = C10\ V,\ \Delta V = \frac{\Delta Q}{C10} \tag{24}$$

Hence, the peak-to-peak ripple voltage ΔV on VF is:

$$\Delta V = 0.00676889\left(\frac{V34}{R24}\right)\left(\frac{1}{C10}\right) \tag{25}$$

($c1$ in farads, $\Delta V$ in volts, $V34$ in volts RMS)

or $$\Delta V = 0.00676889\left(\frac{V34}{R24}\right)\left(\frac{10^6}{C10}\right)(10^3) \tag{26}$$

($C10$ in $\mu F$, $\Delta V$ in mV and $V34$ in volts RMS).

$$\Delta V = 6.76889 \times 10^6 \frac{V34}{R24\ C10} \tag{27}$$

for example, if R24$=10^6$, C10$=10\ \mu$F, V34$=1$ Vrms, $$\Delta V = 6.76889 \times 10^6 \frac{1}{10^5 \times 10} = 0.676889 \text{ mV}$$

ripple. Of course, by choosing different values for various components, the ripple ΔV can be changed.

Amplifiers 44 and 46 are internally compensated and have a roll-off frequency such that there is relatively little gain when the input signal has a frequency of 1 Mhz or greater. For this reason, the full wave rectifier-/amplifier 26 filters out unwanted high frequency noise above 1 Mhz. Additionally, full wave rectifier/amplifier 26 is designed with a delay through it such that there is substantially no response to isolated incidents of spurious inputs.

Test/HRD Switch 24

In order to test IR amplifier 13, test/HRD switch 24 is used. Control computer 27 monitors the flame output signal from full wave rectifier/amplifier 26. Periodically, control computer 27 sends a test pulse into IR amplifier 13 which overrides the flame flicker input signal to IR amplifier 13 from photocell 10. The test pulse causes the flame output signal to ultimately go to zero volts. This is monitored by control computer 27 and, if the flame output signal does in fact go to $<1.8$ volts within a prescribed time interval, in this embodiment 0.5 seconds, the IR amplifier 13 is judged to be working properly. If the flame output signal does not go to $\leqq 1.8$ volts in the prescribed time interval, control computer 27 interprets that as indicating that IR amplifier 13 is not functioning properly. In this preferred embodiment, control computer 27 checks IR amplifier 13 three times in succession and only shuts down the burner if IR amplifier 13 is judged to be working improperly during all three of those checks. This avoids nuisance shutdowns. If IR amplifier 13 fails all three checks, control computer 27 sends a fuel control signal to fuel flow controller 29 which turns off fuel flow to the burner. Also, when the test pulse is removed from IR amplifier 13, the flame output signal should rise again indicating the presence of flame 12. This is also monitored by control computer 27.

Switch 24, in this preferred embodiment, is a bilateral solid state switch which has two signal inputs. The first is at pin 1 where the flame flicker signal across load resistor R5 is applied. The second input, at pin 15, is a control input. When the test computer generates a test pulse, diode CR11 of "OR" connection 22 begins to conduct and control input 15 goes "high." A "high" level on control input 15 causes the first input at pin 1 (the signal across load resistor R5) to be short circuited to ground. This short circuit is achieved for both polarities of the AC flame flicker signal across load resistor R5. (The short circuit path is through approximately 75 ohms which is substantially a short circuit relative to load resistor R5 which is 10 megohms.) It is important that the off resistance of switch 24 is high with respect to R5.

Using this arrangement, after the test pulse is applied, switch 24 will short the input of buffer 16 to ground. Since switch 24 is only short circuiting an AC signal (the flame flicker signal), there will be substantially no step input to buffer 16 from a DC signal being shorted to ground. Therefore, the output of buffer 16 will go to some preselected low value. Control computer 27 will monitor the flame output signal to make sure that it goes to the preselected low value in the prescribed amount of time.

Since the input to buffer 16 is short circuited as a consequence of the test pulse, all the circuitry of IR amplifier 13 from switch 24 and buffer 16 through filter 18 and including full wave rectifier/amplifier 26 is tested by the test pulse. Therefore, nearly all of the circuitry in IR amplifier 13 is tested.

Hot Refractory Detection Circuit 20

Hot refractory detection circuit 20 (HRD circuit 20) is used, as discussed earlier, to avoid an erroneous flame output signal which is caused by the shimmering effect of the hot refractory material. HRD circuit 20 detects a sudden increase in resistance (and consequently voltage) in photocell 10 which results when flame 12 suddenly goes out. When there is a sudden increase in cell resistance in photocell 10, HRD circuit 20 is actuated and causes the flame output signal to go to zero or very close to zero. Control computer 27, which is monitoring the flame output signal, will detect the zero output and send a fuel control signal to fuel flow controller 29 which turns off the fuel supply to the burner.

HRD circuit 20 is comprised of resistors R8, R9, R10, R11, R12, and R13; capacitors C13 and C14; diode CR10; transistor Q1; and amplifier 48. HRD circuit 20 is capacitively coupled to photocell 10 by capacitor C13. Transistor Q1 is connected in a common base configuration with its input at node 50. A sudden increase in the resistance of photocell 10, and consequently a sudden increase in voltage across terminals P and G due to a flame-out condition, will cause an input to appear at input terminal 50 of common base connected transistor Q1. This input will cause more collector current to flow in transistor Q1 and will pull pin 6 of amplifier 48 below the voltage on pin 5 of amplifier 48, which is biased by resistors R11 and R13. This will cause the output of amplifier 14 (pin 7), which is normally "low", to go "high". A "high" output on pin 7 of amplifier 48 regeneratively holds amplifier 48 in the "on" condition, through resistor R12, until C13 has charged up to a level where its charging current has decreased to a point at which amplifier 48 turns off. In that case, the output of amplifier 48 returns to its "low" state.

When amplifier 48 is turned "on" and its output is "high", diode CR8 of "OR" connection 22 begins conducting and provides a "high" voltage level on control input 15 of switch 24. This causes the same result as a test pulse. Switch 24 short circuits the flame flicker signal across load resistor R5 to ground, resulting in the inputs to buffer 16 being shorted to ground. Consequently, the flame output signal goes ultimately to zero as discussed earlier. Control computer 27 will monitor this and send the fuel control signal to fuel flow controller 29 which will turn off the fuel supply to the burner. In this fashion, HRD circuit 20 prevents hot refractory shimmering from producing a false flame output signal when a flame-out condition exists because the HRD signal overrides the flame flicker signal by short circuiting it to ground at switch 24.

By choosing the proper values for the biasing resistors and capacitor C13, amplifier 48 is regeneratively turned on thereby producing the HRD signal for a predetermined amount of time. This is done as follows:

The voltages at pins 5 (Vp5) and 6 (Vp6) of amplifier 48 are:

$$Vp5 = \frac{V\text{supp}\left(\frac{R11}{R13}\right) \pm Vp7\left(\frac{R11}{R12}\right)}{1 + \frac{R11}{R12} + \frac{R11}{R13}} \quad \text{(VIII)}$$

($Vp7 \simeq +5.8\ V$ when "on" and $-5.8\ V$ when "off")

($V\text{supp} = +6.8V$)

$$Vp6 = \frac{V\text{supp}\frac{R9}{R10} - iR9}{1 + \frac{R9}{R10}}; \quad \text{(IX)}$$

-continued when $i = \emptyset$ (no flame-out condition)

$$Vp6 = V\text{supp}\frac{R9}{R9 + R10} \quad (28)$$

i is the instantaneous value of the collector current in transistor Q1

$$\frac{dVp6}{di} = \frac{R9}{1 + \frac{R9}{R10}} \quad (29)$$

Hence, $$\Delta Vp6 = \Delta i\left(\frac{R9}{1 + \frac{R9}{R10}}\right) \quad (30)$$

HRD circuit 20 is designed in this embodiment so that amplifier 48 turns on and produces the HRD signal when the voltage at terminal 50 is approximately equal to 10 v. There are approximately 16.39 V available (33.12 V −16.73 V). Also, HRD circuit 20 turns off when the voltage at terminal 50 is approximately equal to 6.0 V. The turn on and turn off points are analyzed as follows:

Using equations VIII and IX from above, resistors R9–R13 were chosen, in one embodiment, as follows:

R9=1.1M
R10=910k $R9 = 1.1\ M$ $R10 = 910k$ $\frac{R9}{R13} = 1.20879$ $R11 = 1.1\ M$ $R13 = 1\ M$ $\frac{R11}{R13} = 1.0$ $R12 = 22\ M$ $\frac{R11}{R12} = 0.454545$ Using these values in equations VIII and IX, Vp6=3.724−0.498(i) V (i is in μA) (31)

Vp5 on =3.3244+0.1289=3.4533 V (32)

Vp5 off=3.3244−0.1289=3.1955 V (33)

Vp5 on −Vp5 off=0.26 V (34)

Now, the values of current i at which turn-on and turn-off of HRD circuit 20 occur can be determined by equating Vp5 and Vp6 as follows:

Turn-on: Vp6=3.1955=3.724−0.498 ($i_{on}$) (35) $i \simeq_{on}$ 1.06 μA

Turn-off: Vp6=3.4533=3.724−0.498 ($i_{off}$) (36) $i \simeq_{off}$ 0.544 μA

Therefore, as desired, turn on will occur when the voltage at terminal 50 is approximately 10.5 V and turn off will occur at approximately 6.0 V (when including approximately 0.6 V for the base-emitter junction of Q1).

Therefore, HRD circuit 20 will turn off approximately one time constant after flame-out since $$6V \simeq 0.366\ (16.39\ V) \text{ and } e^{-1} = 0.3679. \quad (37)$$

The time constant is:

$$T \simeq C13\ (R8 + Rs) \quad (38)$$

if Rs=473.5k and R8=10 MΩ, then $$T \simeq C13\ (10.4735)s \text{ (for C13 in Mfd.)} \quad (39)$$

which is the on time for HRD circuit 20 and is the time period that HRD circuit 20 will generate the HRD signal after flame-out, assuming the flame-out condition remains. Therefore, if, for example, it is desired that the HRD signal be generated for ≧5.0 s upon flame-out, $$C13 \geqq \frac{5.0}{10.4735} = 0.477 \text{ mfd.} \quad (40)$$

C13 must be a low leakage capacitor.

Capacitor C14 is used as a transient suppressor so that small unwanted transients don't turn transistor Q1 on and off. This enhances noise rejection in HRD circuit 20.

It can be very costly when the burner is shut down unnecessarily. Therefore, if flame 12 goes out but within a short time reignites (for example if fuel hits the hot, glowing refractory material and reignites the burner), it is desirable that HRD circuit 20 should respond to this reignition by removing the HRD signal from control input 15 to switch 24 so that control computer 27 does not shut down the fuel to the burner unnecessarily. When flame 12 reignites, the resistance of photocell 10 immediately decreases from its dark resistance to its light resistance and capacitor C13 in HRD circuit 20 is no longer charging. Rather, capacitor C13 is discharging. Diode CRIO is used to rapidly remove charge from capacitor C13 so that amplifier 48 quickly shuts off thereby removing the HRD signal from control input 15 of switch 24. This allows the flame flicker signal to be buffered by buffer 16 rather than be shorted to ground through switch 24.

Power Supply Circuitry

The supply circuitry in this preferred embodiment is comprised of resistors R1, R29, R30, R31, R32 and R33; capacitors C11, C12, C15 and C17; zener diodes CR5, CR6 and CR9; and diode CR7. A 13 V DC, unregulated power supply is used to power a portion of IR amplifier 13. Resistor R32 and zener diode CR9 divide and regulate the 13 V supply in order to provide IR amplifier 13 with a +6.8 V rail which is well regulated.

Also, a 136 V, 60 Hz floating supply is used, in this preferred embodiment, to power a portion of IR amplifier 13 and to bias photocell 10. Diode CR7; capacitor C11 resistors R29, R30 and R33; 6.8 V zener diode CR5 and 43 V zener diode CR6 convert the 136 V AC supply into a −6.8 V DC rail and a −49.8 V DC rail which are both well regulated and provided to IR amplifier 13. The −6.8 V DC rail is used throughout IR amplifier 13 to bias and supply various circuitry. The −49.8 V DC rail is used to bias photocell 10 through resistors R1 and R31.

Several precautions have been taken in designing IR amplifier 13. All the power supplies are carefully regulated. For example, the ±6.8 V supplies are regulated by zener diodes CR5, CR6 and CR9. Additionally, amplifiers 16, 30, 32, 44, 46 and 48 are all powered by ±6.8 V. This allows clamping of the output to φV. If the amplifiers were powered only by +6.8 V and ground, for instance, the outputs would not be able to be clamped to φV. This feature enhances reliability. Also, the amplifiers are manufactured as a dual and a quad integrated circuit package, and each package has a bypass capacitor between ±6.8 V and −6.8 V. These capacitors, C3 and C8, bypass noise picked up by the power supplies. Further noise rejection is achieved by bypass capacitors C11, C12, C15, C16 and C17 which bypass noise from the power supplies to ground.

Table 1 is a table of component and component values used in one preferred embodiment of the present invention. It is recognized that these components and values represent only one preferred embodiment of the IR amplifier of the present invention and changes may be made without departing from the spirit and scope of the invention.

TABLE I

| Circuit Designation | Component Description |
|---|---|
| R1,R16,R17 | RESISTOR, 619K, ⅛ W, 1%, SMT |
| R2,R3 | RESISTOR, 10K, ⅛ W, 1%, SMT |
| R4,R6,R7 | RESISTOR, 10K, ⅛ W, 1%, SMT |
| R5,R8 | RESISTOR 10 MEG, ⅛ W, 5%, SMT |
| R9 | RESISTOR, 1.1 MEG, 1.8W, 1%, SMT |
| R10 | RESISTOR, 909K, ⅛ W, 1%, SMT |
| R11,R13 | RESISTOR, 1 MEG, ⅛ W, 1%, SMT |
| R12 | RESISTOR, 22 MEG, ⅛ W, 5%, SMT |
| R14,R18 | RESISTOR, 33.2K, ⅛ W, 1%, SMT |
| R15,R27 | RESISTOR, 68.1K, ⅛ W, 1%, SMT |
| R19 | RESISTOR, 18.2K, ⅛ W, 1%, SMT |
| R20,R21 | RESISTOR, 618K, ⅛ W, 1%, SMT |
| R28 | RESISTOR, 1.1 MEG, ⅛ W, 1%, SMT |
| R22,R26 | RESISTOR, 75K, ⅛ W, 1%, SMT |
| R23,R24, R25 | RESISTOR, 150K, ⅛ W, 1%, SMT |
| R29 | RESISTOR, 24K, ½ W, 5%, SMT |
| R30 | RESISTOR, 6.2K, ½ W, 5%, SMT |
| R31 | RESISTOR, 392K, ⅛ W, 1%, SMT |
| R32 | RESISTOR, 2K, ½ W, 5%, SMT |
| R33 | RESISTOR, 30.1K, ⅛ W, 1%, SMT |
| C1 | CAPACITOR, .1 UFD, 10%, 80 V, LEADED |
| C2 | CAPACITOR, .0047 UFD, 10%, 50 V, SMT |
| C3,C8 | CAPACITOR, .1 UFD, 10%, 50 V, SMT |
| C4,C5,C6, C7 | CAPACITOR, .12 UFD, 10%, 50 V, SMT |
| C9 | CAPACITOR, 1 UFD, 10%, 50 V, LEADED |
| C10 | CAPACITOR, .27 MFD, 10%, 50 V, LEADED |
| C11 | CAPACITOR, 20/22 UFD, 20%, 100 V, LEADED |
| C12 | CAPACITOR, 4.7 UFD, 20%, 65 V, LEADED |
| C13 | CAPACITOR, .56 UFD, 10%, 100 V LEADED |
| C14 | CAPACITOR, .001 UFD, 10%, 50 V, SMT |
| C15,C16, C17 | CAPACITOR, .01 UFD, 10%, 50 V, SMT |
| Q1 | TRANSISTOR, LOW NOISE, SMT MM8T5089 |
| U1 | QUAD OP AMP, SMT, LM224D |
| U2 | DUAL FET OP AMP, SMT, TLC272AID |
| U3 | BILATERAL ANALOG SWITCH, DG418 |
| CR1,CR12 | DIODE, DUAL, LOW LEAKAGE, SMT, 8AR14-1 |
| CR3,CR8 | DIODE, DUAL, SMT, M8AV99 |
| CR10,CR11 CR14,CR16 | |
| CR5,CR9 | ZENER DIODE, 6.8 VDC, 5%, IN4692 |
| CR6 | ZENER DIODE, 43 VDC, 5%, IN4717 |
| CR7 | DIODE, IN5060 |
| VR1 | VARISTOR, 270 VDC, 1 MA, V27OMA2A |
| VR2 | TRANSORB, PGKE27 |

CONCLUSION

The present invention provides maximization of the signal-to-noise ratio through IR amplifier 13 by providing for a relatively high voltage on photocell 10. Also, one side of photocell 10 is at ground potential and IR amplifier 13 has a high input impedance. This makes it easy to bypass unwanted and possibly harmful spurious signals (e.g., from ignition electrodes) to ground.

The present invention also provides an input circuit 14 which limits voltage of the flame flicker signal to a voltage which will not damage IR amplifier 13. Input circuit 14 is also designed to substantially eliminate DC voltage at the input to the first buffer stage, buffer 16, in order to avoid a step input which could result in a false flame output signal.

The invention also provides for a bilateral analog solid state switch 24 which is used to short circuit the flame flicker signal to ground at the input of first buffer stage 16 of IR amplifier 13 during a test pulse. Hence, the test pulse is initiated very near photocell 10. This makes it possible to test nearly the entire IR amplifier 13 by generating a periodic test pulse.

Also, the present invention discloses hot refractory detection circuit 20 which is actuated by a sudden large increase in photocell resistance which indicates a flame-out condition. The HRD circuit 20 generates a signal causing bilateral analog solid state switch 24 to be turned on thereby shorting to ground any false flame output signals due to the shimmering effect of the hot refractory material.

The present invention also provides for a substantially square bandpass filter/amplifier 18 which passes a frequency band centered around the flame flicker frequency and rolls off very rapidly at frequencies outside that band. This enhances desired noise rejection characteristics.

Additionally, the present invention also uses full wave AC to DC rectifier/amplifier output circuit 26. This output circuit 26 is designed to charge on both half cycles of the flame flicker signal and to reject spurious input signals.

Although the present invention has been described with reference to preferred embodiments, workers skilled in the art will recognize that changes may be made in form and detail without departing from the spirit and scope of the invention.

What is claimed is:

1. A flame detector for use with flame detection means for detecting the presence of a flame and producing a flame signal which includes an AC component and a DC component when the flame is detected and for producing a no-flame signal when no flame is detected, the flame detector comprising:

input means, coupled to the flame detection means, for receiving and buffering the AC component of the flame signal thereby providing an AC buffered flame signal;

filter means, coupled to the input means, for filtering the AC buffered flame signal thereby providing an AC filtered flame signal;

output means, coupled to the filter means, for amplifying the AC filtered flame signal and for providing a flame output signal;

shorting means, coupled to the input means, for substantially, selectively short circuiting the AC component of the flame signal to a known voltage level; and hot refractory detection means, coupled to the flame detection means, for detecting the no-flame signal and for generating an HRD signal causing the AC component of the flame signal to be substantially short circuited to a known voltage level, thereby substantially eliminating a false flame output signal caused by hot refractory shimmering.

2. The flame detector of claim 1 wherein the DC component reaches a flame-on level which represents the presence of the flame and a flame-out level which represents the absence of the flame.

3. The flame detector of claim 1 wherein the AC component represents flame flicker when the flame is present and has a flicker frequency, and wherein the AC component is coupled to the input means by AC coupling means.

4. The flame detector of claim 3 wherein the input means further comprises:

limiting means, AC coupled to the flame detection means by the coupling means, for limiting the AC component to a predetermined level to prevent damage to the flame detector.

5. The flame detector of claim 4 wherein the limiting means further comprises:

a first diode with its input coupled to the AC coupling means and its output coupled to a bias voltage where the first diode is reverse biased and where the first diode begins to conduct when the AC component rises above a predetermined level; and a second diode with its input coupled to a bias voltage and its output coupled to the AC coupling means where the second diode is reverse biased and where the second diode begins to conduct when the AC component drops below a predetermined level.

6. The flame detector of claim 5 wherein the first and second diodes are contained on a monolithic chip.

7. The flame detector of claim 6 wherein leakage currents of the first and second diodes are substantially equal.

8. The flame detector of claim 4 wherein the input means further comprises:

input filter means for bypassing noise in the AC component to ground.

9. The flame detector of claim 8 wherein the input means further comprises:

load resistance means, coupled to the input filter means, for loading the AC component, where the AC component appears across the load resistance means, and where substantially no DC voltage appears across the load resistance means.

10. The flame detector of claim 9 wherein the shorting means further comprises:

a control input for receiving the switch-close signal;

a first switch terminal coupled to the load resistance means; and a second switch terminal, coupled to a known voltage, wherein the shorting means substantially short circuits the first switch terminal to the second switch terminal when the switch-close signal is applied to the control input.

11. The flame detector of claim 10 wherein the shorting means comprises:

an analog, bilateral, solid-state switch.

12. The flame detector of claim 9 wherein the input means further comprises:

buffer means, coupled to the load resistance means, for buffering the AC component and thereby providing the AC buffered flame signal.

13. The flame detector of claim 12 wherein the buffer means includes an operational amplifier.

14. The flame detector of claim 3 wherein the filter means further comprises:

a multiple feedback, bandpass filter with a first and second stage.

15. The flame detector of claim 14 wherein the first and second stages are stagger-tuned to pass the flicker frequency.

16. The flame detector of claim 15 wherein the filter means amplifies the AC buffered flame signal.

17. The flame detector of claim 3 wherein the shorting means further comprises a switch which short circuits the AC component of the flame signal to the known voltage upon receiving a switch-close signal.

18. The flame detector of claim 17 wherein the switch-close signal is generated by a test pulse.

19. The flame detector of claim 17 wherein the switch-close signal is generated by the HRD signal.

20. The flame detector of claim 1 wherein the output means full-wave rectifies the AC component thereby providing a rectified flame signal.

21. The flame detector of claim 20 wherein the output means amplifies the rectified flame signal thereby providing an amplified flame signal.

22. The flame detector of claim 21 wherein the output means converts the amplified flame signal to substantially a DC signal thereby providing the flame output signal.

23. The flame detector of claim 1 wherein the flame detector means further comprises a photocell which has a variable, photosensitive resistance that varies as a function of infrared radiation impinged upon it.

24. The flame detector of claim 23 wherein the photosensitive resistance reaches a dark resistance value when the flame is absent and a light resistance value when the flame is present.

25. The flame detector of claim 24 wherein the photosensitive resistance varies due to variations in the amount of infrared radiation incident upon the photocell as a result of flame flicker.

26. The flame detector of claim 25 wherein the DC component of the flame signal represents the dark resistance when the flame is absent and the light resistance when the flame is present, and wherein the AC component of the flame signal represents the changes in the photosensitive resistance due to the flame flicker.

27. The flame detector of claim 26 wherein the photocell is biased by a voltage in excess of 10 V.

28. A flame detector for use with a photocell which produces a flame signal when exposed to a flame, the flame detector comprising:

input means, coupled to the photocell, for receiving and buffering the flame signal thereby providing a buffered signal;

filter means, coupled to the input means, for filtering and amplifying the buffered signal thereby providing a filtered flame signal;

output means, coupled to the filter means, for further amplifying the filtered flame signal thereby providing an output flame signal;

switch means, coupled to the photocell, for selectively, substantially short circuiting the flame signal to a known voltage value; and hot refractory detection means, coupled to the photocell for detecting a flame-out condition and generating an HRD signal causing the flame signal to be substantially short circuited to a known voltage value thereby eliminating a false flame signal caused by hot refractory shimmering.

29. The flame detector of claim 28 wherein the flame signal, as produced by the photocell, has a DC component, which reaches a flame-out level when the flame-out condition exists and reaches a flame-on level when the flame is present, and which has an AC ripple component.

30. The flame detector of claim 29 wherein the hot refractory detection means detects a change in the DC component of the flame signal and generates an HRD signal when the DC component of the flame signal reaches the flame-out level.

31. The flame detector of claim 30 wherein the hot refractory detection means generates the HRD signal for an HRD override time period.

32. The flame detector of claim 31 wherein the HRD override time period is determined by the shorter of a predetermined time period and a flame-out period representing the time that the flame-out condition exists.

33. The flame detector of claim 32 wherein the hot refractory detection means stops generating the HRD signal before the predetermined time period is ended where the DC component of the flame signal returns to the flame-on level.

34. The flame detector of claim 33 wherein the switch means is actuated and substantially short circuits the flame signal to the known voltage upon receiving a switch-close signal.

35. The flame detector of claim 34 wherein the switch-close signal is generated by the HRD signal.

36. The flame detector of claim 34 wherein the switch-close signal is generated by an amplifier test pulse.

37. The flame detector of claim 34 wherein the HRD means further comprises:

first amplifier means having a first amplifier input and a first amplifier output;

first coupling means, for coupling the photocell to the first amplifier input, where the first coupling means provides a turn-on signal, which is representative of the flame-out level of the DC component of the flame signal, at the first amplifier input for a time period determined by the shorter of the predetermined time period and the flame-out period;

second amplifier means, having a first input, a second input and an output, for providing the HRD signal when the flame-out condition exists, where the first input is coupled to the first amplifier output, and the second input is biased and coupled to the output of the second amplifier means such that the output of the second amplifier means provides the HRD signal while the flame-out condition is presented to the first amplifier input; and second coupling means for coupling the output of the second amplifier means to the switch means.

38. The flame detector of claim 37 wherein the first amplifier means further comprises a common-base connected transistor.

39. The flame detector of claim 38 wherein the first coupling means further comprises:

a capacitor with first and second capacitor terminals;

a resistor with first and second resistor terminals; and a diode with first and second diode terminals where the first capacitor terminal is coupled to the photocell and the second capacitor terminal is coupled to the first resistor terminal and where the second resistor terminal is coupled to the input of the common-base connected transistor and also to the first diode terminal, and where the second diode terminal is coupled to ground.

40. The flame detector of claim 37 wherein the second amplifier means further comprises an operational amplifier.

41. The flame detector of claim 37 wherein the second coupling means further comprises a diode connected between the output of the second amplifier means and the switch means.

42. A flame signal amplifier for use with a flame detector that produces a flame signal, having an AC component and a DC component, when exposed to a flame, the flame signal amplifier comprising:

input means, coupled to the flame detector, for receiving and buffering the AC component of the flame signal, thereby providing an AC buffered flame signal;

filter means, coupled to the input means, for filtering the AC buffered flame signal, thereby providing an AC filtered flame signal; and output means, coupled to the filter means, for full wave rectifying the AC filtered flame signal, amplifying the AC filtered flame signal, and converting the AC filtered flame signal into a flame output signal that is substantially a DC signal.

43. The flame signal amplifier of claim 42 wherein the output means further comprises:

rectifier means for full wave rectifying the AC filtered flame signal;

capacitance means for providing the flame output signal;

first amplifier means for amplifying a first half cycle of the AC filtered flame signal to produce a first amplified flame signal and applying it to the capacitance means; and second amplifier means for amplifying a second half cycle of the AC filtered flame signal and to produce a second amplified flame signal and applying it to the capacitance means where the capacitance means charges during the first and second half cycle of the AC filtered flame signal.

44. The flame signal amplifier of claim 42 wherein the filter means further comprises:

a multiple feedback, band pass filter with a first and a second stage.

45. The flame signal amplifier of claim 44 wherein the first stage is tuned to have a maximum gain at a frequency of 11.3 Hz.

46. The flame signal amplifier of claim 44 wherein the second stage is tuned to have a maximum gain at a frequency of approximately 14.9 Hz.

47. The flame signal amplifier of claim 44 wherein the filter means has an overall gain at a frequency of 8.5 Hz and 19.5 Hz that is approximately 20% of the gain at 14.0 Hz, and an overall gain at a frequency of 35.0 Hz and 5.0 Hz which is less than 2% of the gain at 14.0 Hz.

48. The flame signal amplifier of claim 42, and further comprising:

switch means, coupled to the input means, for substantially, selectively short circuiting the AC component of the flame signal to a known voltage level.

49. The flame signal amplifier of claim 48, and further comprising:

hot refractory detection means, coupled to the flame detector, for detecting a flame-out condition and generating an HRD signal causing the flame signal to be substantially short circuited, to a known voltage value thereby eliminating a false flame signal caused by hot refractory shimmering.

50. The flame signal amplifier of claim 49 wherein the switch means short circuits the AC component of the flame signal to the known voltage upon receiving a switch-close signal.

51. The flame signal amplifier of claim 50 wherein the switch-close signal is generated by a test pulse.

52. The flame signal amplifier of claim 51 wherein the switch-close signal is generated by the HRD signal.

53. A flame detector, comprising:

a photocell for producing a flame signal having an AC and a DC component, when exposed to a flame, the photocell producing the flame signal across a first and a second terminal where the first terminal is substantially at ground potential to facilitate bypassing noise to ground;

input means, coupled to the photocell, for receiving and buffering the AC component of the flame signal thereby providing an AC buffered flame signal;

filter means, coupled to the input means, for filtering the AC buffered flame signal thereby producing an AC filtered flame signal;

output means, coupled to the filter means, for amplifying the AC filtered flame signal to provide a flame output signal; and switch means coupled to the input means, for substantially short circuiting the AC component of the flame signal to a known voltage level upon receiving a switch-close signal.

54. The flame detector of claim 53 and further comprising hot refractory detection means, coupled to the flame detection means, for detecting a flame-out condition and generating the switch-close signal causing the flame signal to be substantially short circuited to a known voltage value thereby eliminating a false flame signal caused by hot refractory shimmering.

55. The flame detector of claim 53 wherein the switch-close signal is actuated by a test pulse.

56. The flame detector of claim 53 wherein the photocell is biased by a voltage which is greater than 10 V.

* * * * *